US012686550B2

(12) United States Patent
Su

(10) Patent No.: US 12,686,550 B2
(45) Date of Patent: Jul. 21, 2026

(54) OBJECT STORAGE BOX STRUCTURE

(71) Applicant: Ying Hui Su, Taipei (TW)

(72) Inventor: Ying Hui Su, Taipei (TW)

( * ) Notice: Subject to any disclaimer, the term of this patent is extended or adjusted under 35 U.S.C. 154(b) by 0 days.

(21) Appl. No.: 18/825,383

(22) Filed: Sep. 5, 2024

(65) Prior Publication Data

US 2026/0062192 A1 Mar. 5, 2026

(51) Int. Cl.

| | |
|---|---|
| ***B65D 25/10*** | (2006.01) |
| ***B25H 3/02*** | (2006.01) |
| ***B65D 21/02*** | (2006.01) |
| ***B65D 25/20*** | (2006.01) |
| ***B65D 25/32*** | (2006.01) |
| ***B65D 43/16*** | (2006.01) |
| ***B65D 77/04*** | (2006.01) |

(52) U.S. Cl.

CPC ..... *B65D 77/0453* (2013.01); *B65D 21/0223* (2013.01); *B65D 25/205* (2013.01); *B65D 25/32* (2013.01); *B65D 43/166* (2013.01); *B65D 2577/043* (2013.01)

(58) Field of Classification Search

CPC ..... A01K 97/06; A01K 87/009; B65D 1/34; B65D 1/36; B65D 21/0223; B65D 25/205; B65D 25/32; B65D 43/166; B65D 77/0453; B65D 2203/06; B65D 2577/043; B65D 43/16; B25H 3/02; B25H 3/021; B25H 3/023; B25H 3/022; B25H 3/06; Y10S 220/12

USPC ..... 16/427, 408, 405; 206/508, 373, 493, 206/509, 526, 223; 220/752, 756, 757, 220/762, 764, 23.88

See application file for complete search history.

(56) References Cited

U.S. PATENT DOCUMENTS

| | | | | | |
|---|---|---|---|---|---|
| 2,558,955 | A | * | 7/1951 | Hilton | B65D 25/108 312/351 |
| 2,564,235 | A | * | 8/1951 | Roethel | F25C 1/24 249/141 |
| 2,677,479 | A | * | 5/1954 | Kiba | E05D 5/10 16/257 |
| 2,732,581 | A | * | 1/1956 | Heck | E05D 5/10 16/257 |
| 3,878,964 | A | * | 4/1975 | Fogle | F16M 13/00 294/142 |
| 4,515,419 | A | * | 5/1985 | Hampel | F16M 13/00 220/756 |
| D281,836 | S | * | 12/1985 | Sparkman | D3/905 |

(Continued)

FOREIGN PATENT DOCUMENTS

SE 543107 C2 * 10/2020 ..... B25H 3/023

*Primary Examiner* — Gideon R Weinerth

(57) ABSTRACT

An object storage box structure, the main feature of which is that the bottom of an outer box and the top of a cover are configured with the same crisscrossing ridge lines to form a plurality of recessed compartments, and each inner box is configured with corresponding beveled bottom so that the inner box can be placed in the corresponding recessed compartment at a fixed position to improve the convenience of positioning the inner box. It can be stored stably in the outer box or taken out and placed smoothly on the lid; in addition, the object storage box is also equipped with a snap mechanism, which can be stacked and combined with multiple upper and lower locks during use, and a pivoting handle that can be pushed in for storage, pulled out for carrying, and can even be used for diagonal support and display.

14 Claims, 11 Drawing Sheets

(56) References Cited

U.S. PATENT DOCUMENTS 4,589,546 A * 5/1986 Sunderland ..... A01K 97/06 220/252
5,344,024 A * 9/1994 Cohu ..... B07C 7/04 209/706
5,813,531 A * 9/1998 Kao ..... B25H 3/003 220/756
6,115,883 A * 9/2000 Um ..... G06F 1/1616 220/756
6,301,825 B1 * 10/2001 Doreian ..... A01K 97/06 43/57.1
7,246,704 B2 * 7/2007 Brunson ..... B25H 3/003 220/23.88
7,357,250 B2 * 4/2008 Hagemann ..... A01K 97/06 206/315.11
7,661,530 B1 * 2/2010 Hewitt ..... A45C 11/24 220/523
D648,548 S * 11/2011 Winer ..... D6/675.1
8,459,488 B2 * 6/2013 Pannier ..... A45C 13/02 220/23.88
8,505,729 B2 * 8/2013 Sosnovsky ..... B65D 45/22 220/756
D725,388 S * 3/2015 Cole ..... D3/282
D787,186 S * 5/2017 Thurbin ..... D3/313
D795,579 S * 8/2017 Sarfati ..... D3/905
10,722,012 B2 * 7/2020 Kraus ..... A45C 5/03
11,345,512 B1 * 5/2022 Zheng ..... B65D 51/242
D998,337 S * 9/2023 Tortorella, Jr. ..... D3/283
D1,048,717 S * 10/2024 Roberts ..... D3/319
D1,048,718 S * 10/2024 Roberts ..... D3/319
12,342,805 B1 * 7/2025 Kamada ..... A01K 97/06
D1,098,747 S * 10/2025 Tortorella, Jr. ..... D3/283
D1,099,532 S * 10/2025 Tortorella, Jr. ..... D3/276
12,459,702 B2 * 11/2025 Forchione ..... B25H 3/04
2007/0272572 A1 * 11/2007 Chen ..... B25H 3/021 206/373
2009/0223853 A1 * 9/2009 Kim ..... B65D 21/0213 206/509
2012/0318792 A1 * 12/2012 Larson ..... B25H 3/02 220/23.88
2014/0014714 A1 * 1/2014 Tang ..... B65D 25/205 235/375
2017/0165829 A1 * 6/2017 Damberg ..... A45C 13/02
2019/0009403 A1 * 1/2019 Huang ..... B65D 21/023
2020/0039056 A1 * 2/2020 Damberg ..... B65D 25/10

* cited by examiner

OBJECT STORAGE BOX STRUCTURE

FIELD OF THE INVENTION

The present invention relates to the technical field of a component storage appliances, and in particular, to an object storage box structure.

THE PRIOR ARTS

With the improvement of the quality of life, people's demand for the storage of items is increasing day by day. The commonly known storage box design is mainly composed of two corresponding upper and lower boxes. One side of the two boxes is pivoted, the other side is fixed with a buckle. There are usually multiple partitions inside the storage box to classify and store various small items such as screws or nuts. However, due to the poor partitioning effect of the partitions, these small items often shift due to shaking during the carrying process, resulting in confusion of parts and making it difficult for users to quickly find the parts they need when needed. In addition, the conventional storage box structure also has the following shortcomings:

1. The existing storage box space is not fully utilized. The partition design of many storage boxes is too fixed and lacks flexibility and cannot adapt to the storage needs of different types of objects. It can be adjusted according to the size of the object, which makes small objects in a large space. It is easy to slide in the middle, but large objects cannot be placed effectively, resulting in a waste of space and increasing the trouble of use.
2. The openings of some existing storage boxes are too small, and the depth is too large, making it difficult to take out the objects placed at the bottom. Users will also feel inconvenience when accessing the objects. They need to flip or move the entire box. This not only a waste of time may also cause damage to the object.
3. Many storage boxes lack effective classification and clear labeling in design, making it impossible to find the specific items that they want easily and quickly. As a result, users need to spend a lot of time rummaging, which is not only inefficient but also increases frustration for the difficulty of finding object.

Although there have been various advanced and improved storage boxes on the market, their space planning and practical functions are still imperfect, and they cannot effectively classify and stabilize objects, resulting in objects easily falling apart during collection and use. Not only affects the user's convenience, but also reduces the efficiency of storage and access.

SUMMARY OF THE INVENTION

In view of this, the main purpose of the present invention is to provide an object storage box structure, which mainly comprises: an outer box and a plurality of inner boxes, a lid is pivoted on an edge of the outer box for closing or opening, a space inside the outer box is that the plurality of inner boxes are accommodated, which is characterized by:

An inner bottom of the outer box configured with crisscrossing ridge lines to form a plurality of recessed compartments, and each inner box is configured with a corresponding beveled bottom so that the inner box can be placed at a fixed position, and stable storage in the plurality of corresponding recessed compartments of the outer box, making it easy to classify and store different objects in the outer box to avoid confusion and scattering of objects;

A top of the lid is configured with the same crisscrossing ridge lines to form the plurality of recessed compartments, so that after each inner box is taken out, each inner box can be placed in a fixed position in the corresponding recessed compartment on the lid for stability. Effectively preventing it from tipping over when picking up items.

Two short opposite sides of the outer box are each configured with a pivot for pivoting a U-shaped handle, ends of two arms of the handle are each configured with a pivoting long hole so that the handle can be push in to be retracted from a front of the outer box, and to be pulled out, turn to stand up for carry the handle; and A bottom of the outer box corresponds to the top of the lid, and at least one set of snap mechanisms is configured on a side of the outer box and a side of the lid, so that a plurality of storage boxes can be stacked and combined with each other.

In a preferred embodiment, wherein each middle section located on two arms of the handle are further configured with a rotating bracket, wherein the handle is opened, the rotating bracket is pushed out of abut against the bottom of the outer box, so that the outer box body is supported at an inclined angle.

In a preferred embodiment, wherein the lid is further configured with an edge portion in front, a through hole is configured on the edge portion to pass through a strap, which are tied together with the retracted handle of the outer box to prevent from being opened secretly.

In a preferred embodiment, wherein the inner box is rectangle or square and further has a one-way opening edge portion, and a longitudinal groove is configured on each of four outer walls of the inner box, the inner box is further configured with a small cover accordingly, the inner edge of the cover body which is configured with a clamping edge to correspond to the opening edge portion of the inner box, the small cover is configured with a hanging hole for hanging on the display stand, the inner box has different sizes and is further configured into a single unit, two conjoined units, or four conjoined units.

Compared with the existing conventional structure, the object storage box structure of the present invention has the advantages that it is particularly convenient for classifying, placing and stably collecting various small objects. The product structure design is excellent, the functionality is good, and it can be effectively used. It improves the efficiency of sorting and storing objects and also facilitates the stability of taking out and placing them for use. The object storage box structure of the present invention can not only effectively solve the shortcomings of existing storage boxes. In addition, the invention also has many practical functions such as convenient combination and stacking, handle positioning, oblique support display, mobile phone placement, anti-theft opening, small box packaging and hanging, etc. The innovative design can meet modern needs, allowing users to enjoy greater convenience and efficiency when organizing and storing small items on a daily basis.

DETAILED DESCRIPTION OF PREFERRED EMBODIMENTS

Figure 1:
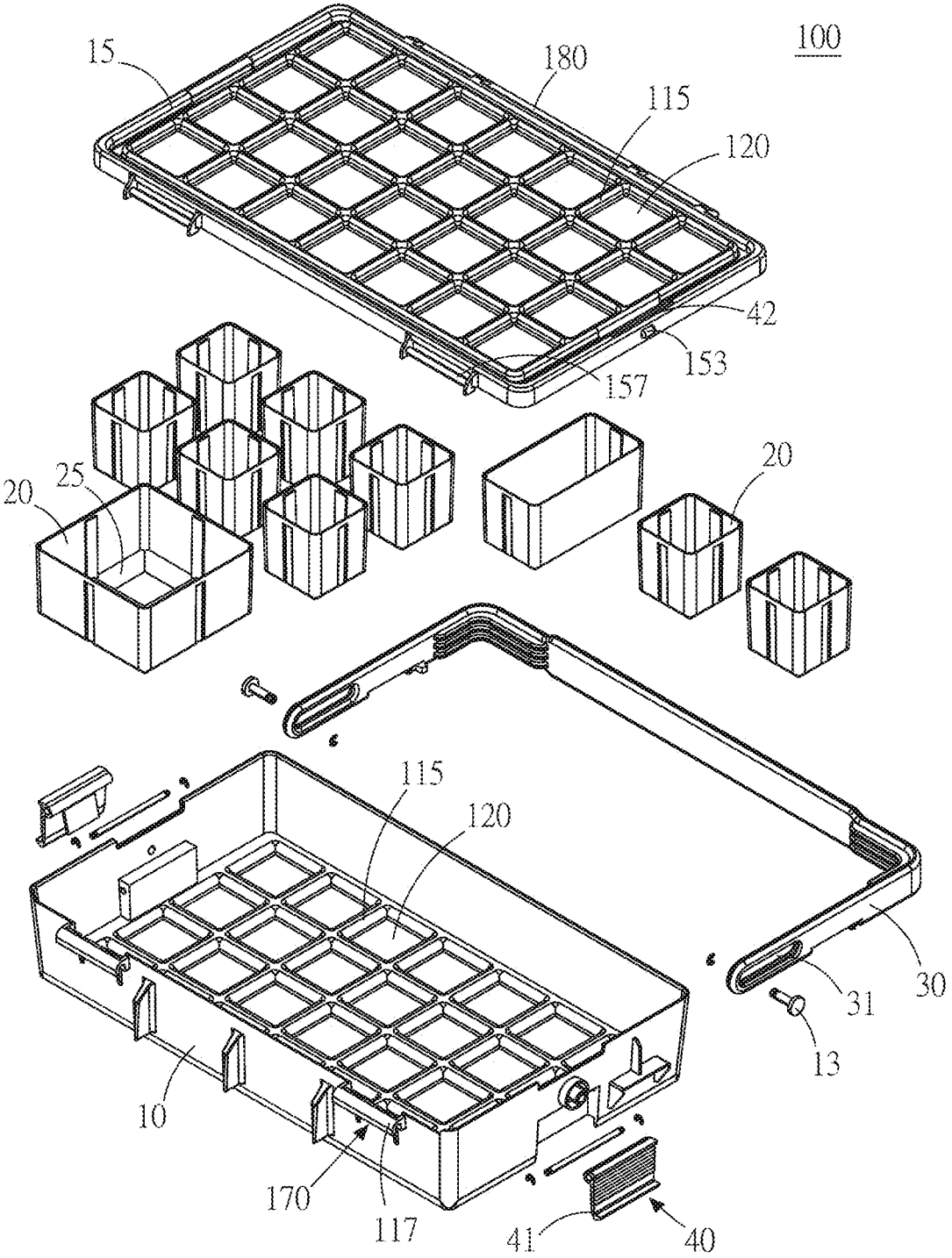
FIG. 1 is an exploded stereo view of the structure of the object storage box of the present invention.

In order to facilitate understanding of the content of the present invention and the effects that can be achieved, specific embodiments are enumerated in conjunction with the drawings, and the detailed description is as follows. Please refer to FIGS. 1 to 6, an object storage box 100 according to the present invention. The structure of the object storage box 100 mainly comprises an outer box 10 and a plurality of inner boxes 20, a lid 15 pivoted on an edge of the outer box 10 for closing or opening, and a space inside the outer box 10.

In a preferred embodiment, an inner bottom of the outer box 10 configured with crisscrossing ridge lines 115 to form a plurality of recessed compartments 120, and each inner box 20 is configured with a corresponding beveled bottom 25 so that the inner box 20 can be placed at a fixed position, and stable storage in the plurality of corresponding recessed compartments 120 of the outer box 10. It is convenient to classify and store different objects in the outer box 10 to avoid confusion and scattering of objects.

In a preferred embodiment, a top of the lid 15 is configured with the same crisscrossing ridge lines 115 to form the plurality of recessed compartments 120, so that after each inner box 20 is taken out, each inner box 20 can be placed in a fixed position in the corresponding recessed compartment 120 on the lid 15 for stability. Effectively prevents tipping over when picking up objects.

Two short opposite sides of the outer box 10 are each configured with a pivot 13 for pivoting a U-shaped handle, ends of two arms of the handle are each configured with a pivoting long hole 31 so that the handle can be push in to be retracted from a front of the outer box 10, and to be pulled out, turn to stand up for carry the handle; and A bottom of the outer box 10 corresponds to the top of the lid 15, and at least one set of snap mechanisms 40 is configured on a side of the outer box 10 and a side of the lid 15, so that a plurality of storage boxes can be stacked and combined with each other.

Figure 4:
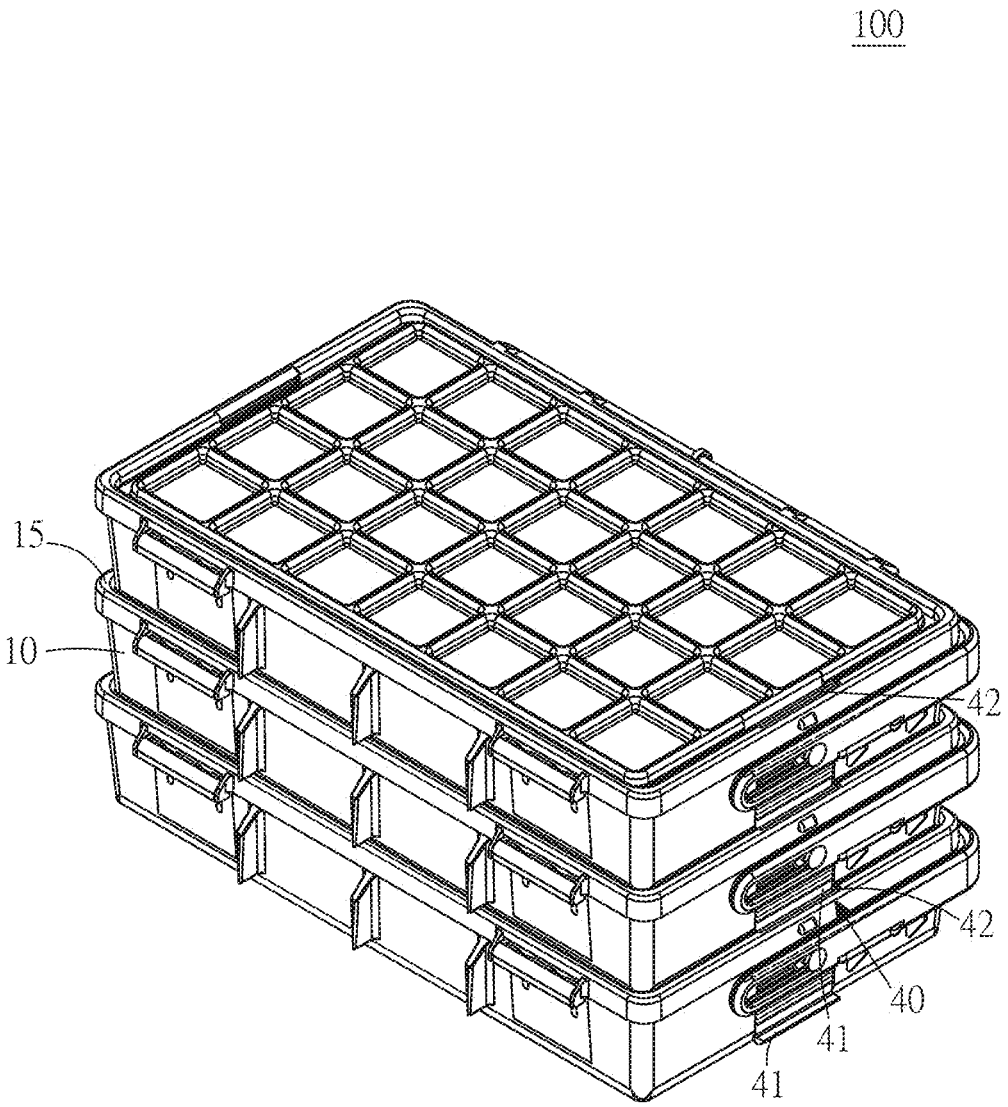
FIG. 4 is an application example of multiple stacked combinations of object storage boxes according to the present invention.

In a preferred embodiment, as shown in FIG. 1, FIG. 4. Wherein the outer box 10 and the lid 15 are rectangular, the snap mechanism 40 is further configured with a hook 41 on two short sides of the outer box 10 formed as recesses downward, corresponding two short sides of the lid 15 are each configured with a buckle portion 42. When the object storage boxes 100 are stacked, the hooks 41 of the upper outer box 10 and the buckle portions 42 of the lower lid 15 can be engaged with each other.

Figure 5:
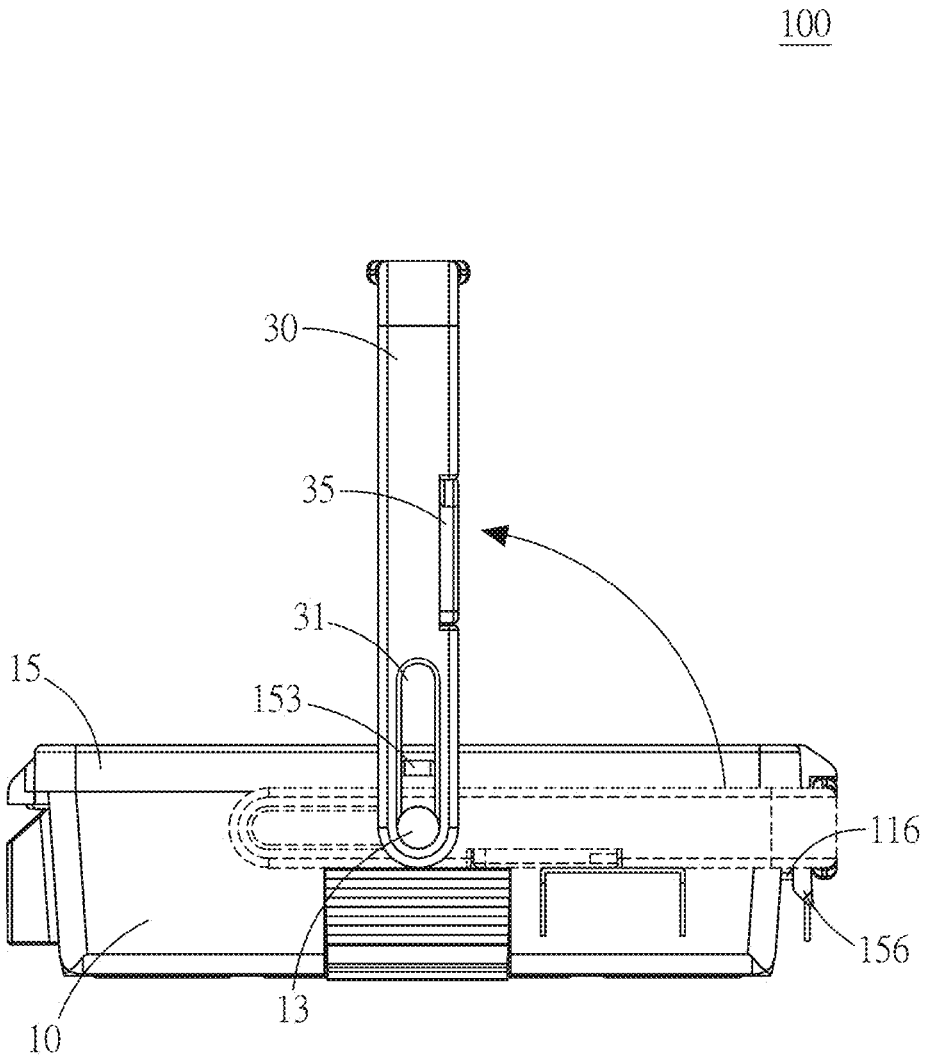
FIG. 5 is an application example in which the handle of the object storage box of the present invention can be positioned and erected.

In a preferred embodiment, as shown in FIG. 1, FIG. 5. Wherein a protruding piece 153 is further configured on each middle side of two short sides of the lid 15, so that the handle can be erected by way of the corresponding pivoting long hole 31 at both ends thereof to stopping position. When the handle 30 is rotated upward, the handle 30 can be positioned just upright to facilitate carrying.

Figure 2:
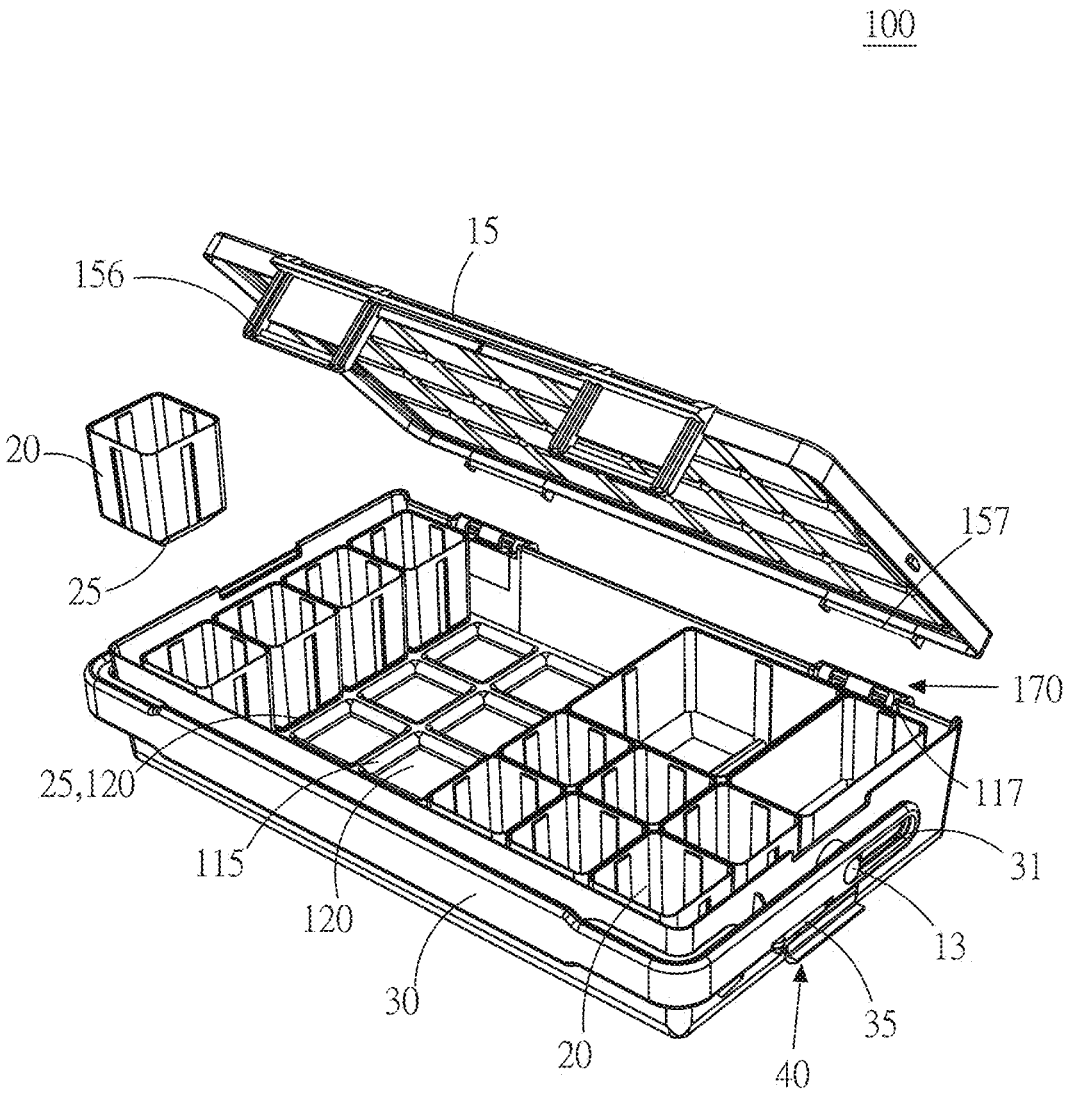
FIG. 2 is an application example of the object storage box of the present invention where the inner box can be opened and placed in categories.
Figure 3:
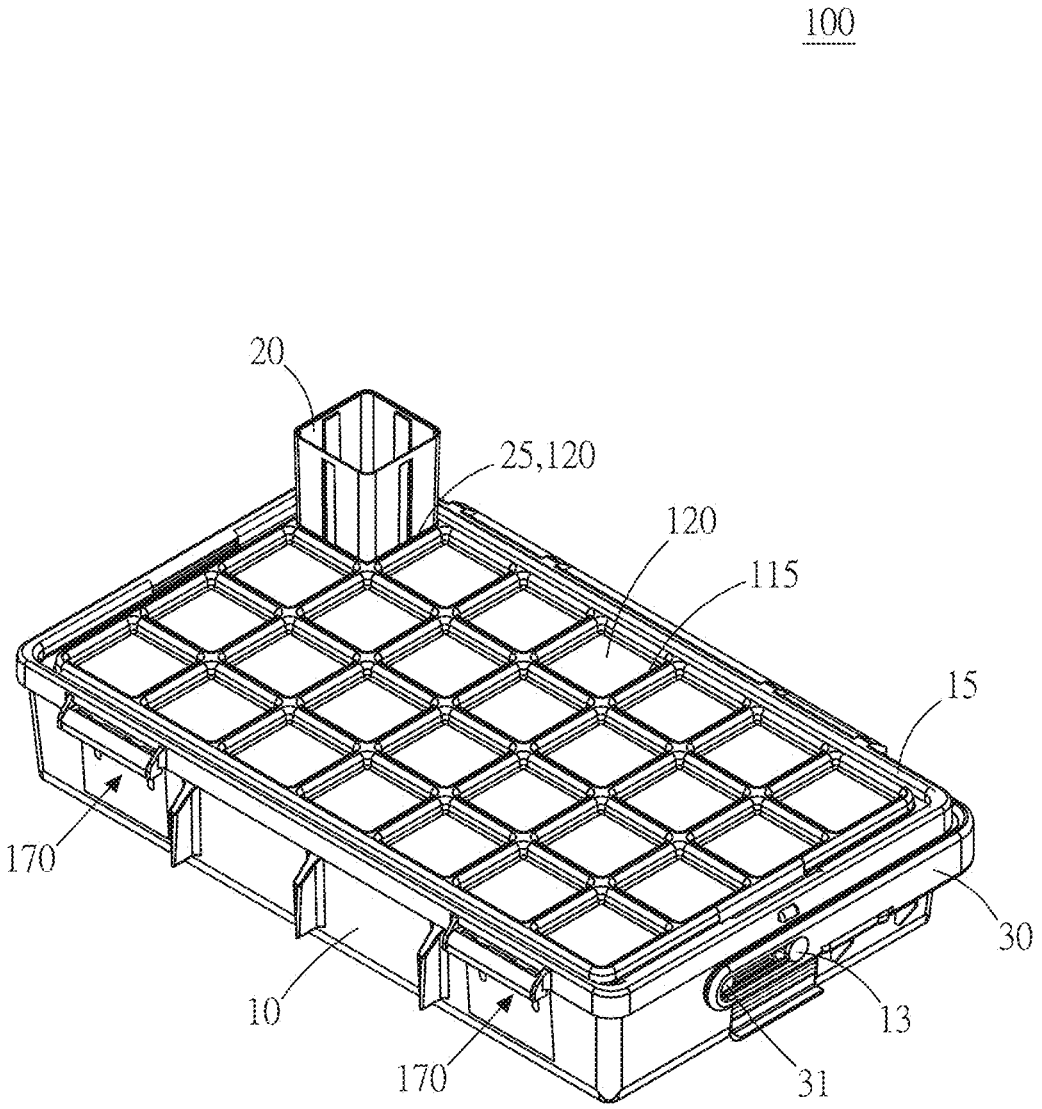
FIG. 3 is an application example of the present invention in which the inner box is taken out and placed on the lid of the object storage box.
Figure 6:
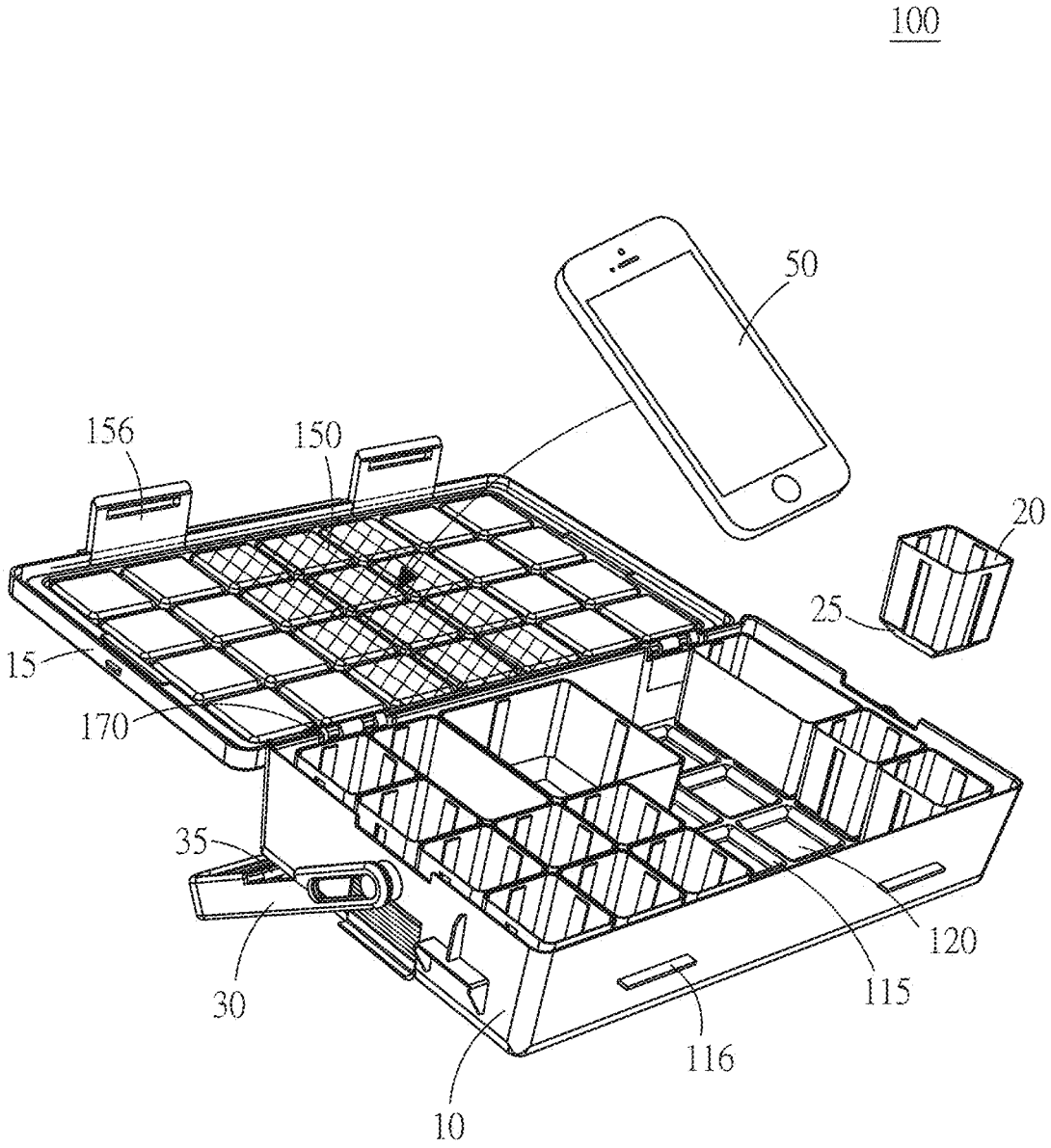
FIG. 6 is an application example of the oblique support frame of the object storage box of the present invention.
Figure 7:
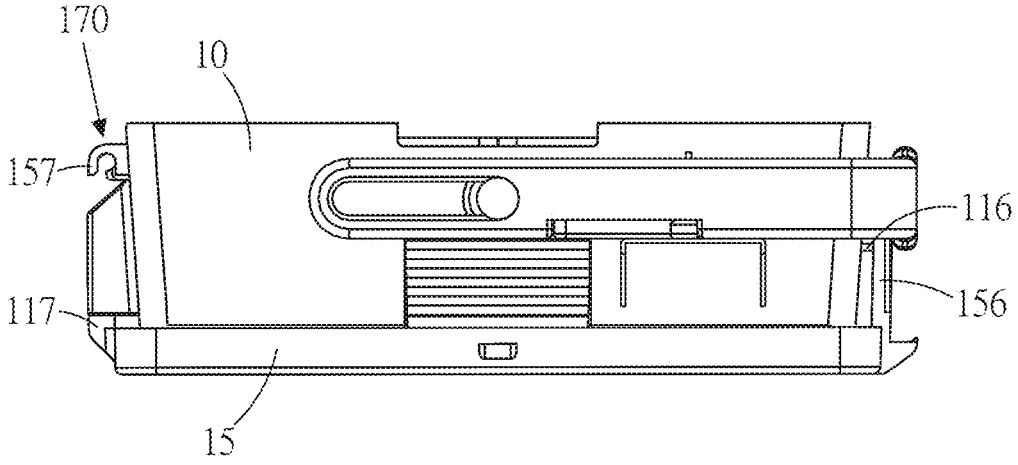
FIG. 7 is an application example of the invention in which the cover of the object storage box can be quickly detached and placed under the outer box body.

In a preferred embodiment, as shown in FIG. 2, FIG. 6. Wherein each middle section located on two arms of the handle are further configured with a rotating bracket 35, wherein the handle is opened, the rotating bracket 35 is pushed out of abut against the bottom of the outer box 10, so that the outer box 10 is supported at an inclined angle. In addition to being used for display, it can also be used for easy access to objects. For example, the outer box 10 can be supported at an angle of 30 degrees, but it is not limited to this in practice.

In a preferred embodiment. An inner side of the lid 15 is further configured with a mobile phone placement position 150. The cover 15 with the diagonal support opened can be used to place the mobile phone 50, so that the mobile phone 50 can be viewed at the same time when taking things.

In a preferred embodiment, as shown in FIG. 1 to FIG. 3 and FIG. 7, the lid 15 is further configured with two elastic tabs 156 extending outward and folding downward, symmetrically arranged on a long side. The outer box 10 is configured with two lugs 116 spaced apart on the corresponding long side, allowing the lid 15 and the outer box 10 to be clamped together during normal use. The lid 15 is equipped with a quick release mechanism 170. Two pivot rods 157, spaced apart, are configured on the other long side of the lid 15. The corresponding long side of the outer box 10 has two slotted pivot hinges 117 spaced apart, enabling the lid 15 to be rotated up and pushed down to separate from the outer box 10 for removal. The lid 15 can be turned over when placed upside down under the outer box 10, with the two elastic tabs 156 locking together with the two lugs 116 of the outer box 10. This special function increases convenience of use. The outer box 10 and the lid 15 can be stacked together, and the inner box 20 can be neatly stored and placed directly in a drawer. The drawer can be quickly accessed, and objects in the inner box 20 can be directly taken out.

Figure 8:
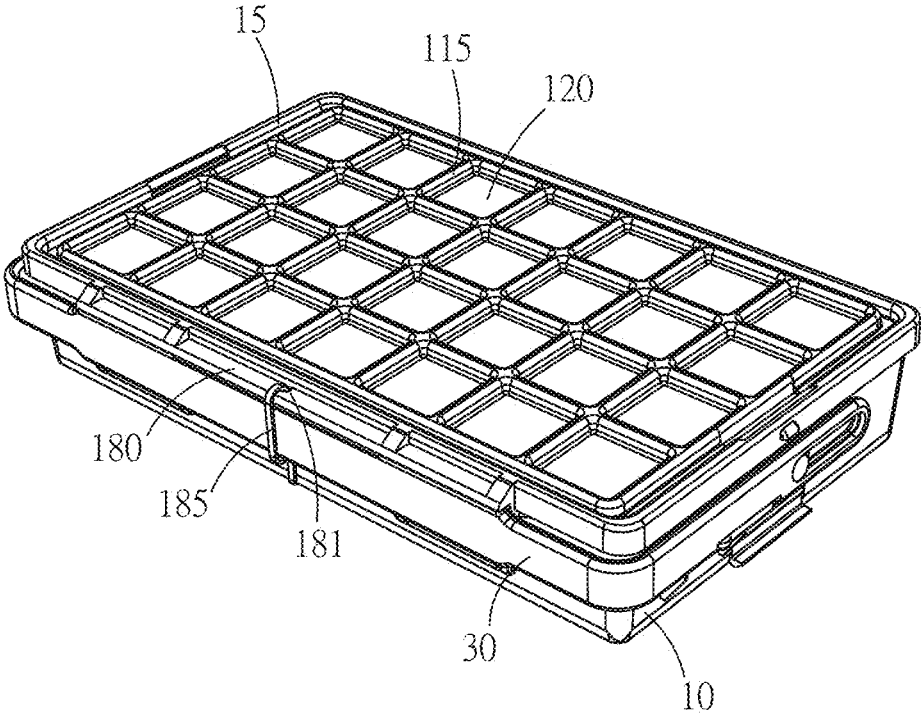
FIG. 8 is an application example having a strap on the object storage box of the present invention.

In a preferred embodiment, as shown in FIG. 1, FIG. 8. wherein the lid 15 is further configured with an edge portion 180 in front, a through hole 181 is configured on the edge portion 180 to pass through a strap 185, that are tied together with the retracted handle of the outer box 10. When the product is sold on a retail shelf, the lid 15, the outer box 10, and the handle 30 can be tied and locked to prevent them from being easily opened to prevent theft.

Figure 9A:
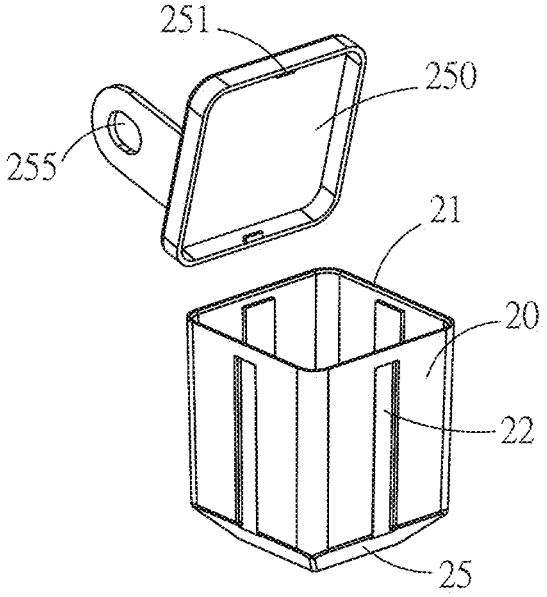
FIG. 9A to 9C are schematic diagrams of inner boxes of different sizes and their small lids according to the present invention.

In a preferred embodiment, as shown in FIG. 9A, wherein the inner box 20 is rectangle or square and further has a one-way opening edge portion 21, and a longitudinal groove 22 is configured on each of four outer walls of the inner box 20, the inner box 20 is further configured with a small cover 250 accordingly, the inner edge of the cover body which is configured with a clamping edge 251 to correspond to the opening edge portion 21 of the inner box 20, the small cover 250 is configured with a hanging hole 255 for hanging on the display stand, so that consumers can disassemble and place it into the outer box 10 after purchase. When the small inner box 20 is taken out, the small cover 250 can also be closed again, so that it can be easily closed and carried out independently.

Figure 9B:
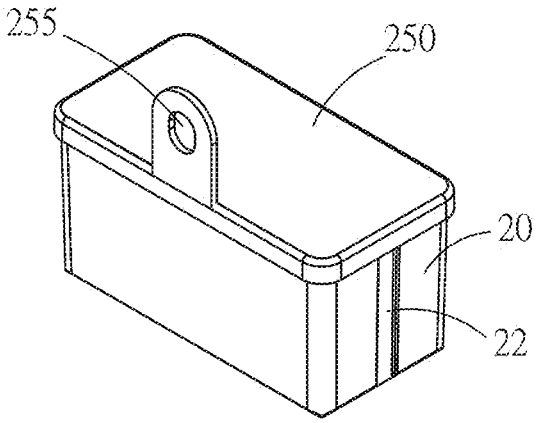
Figure 9C:
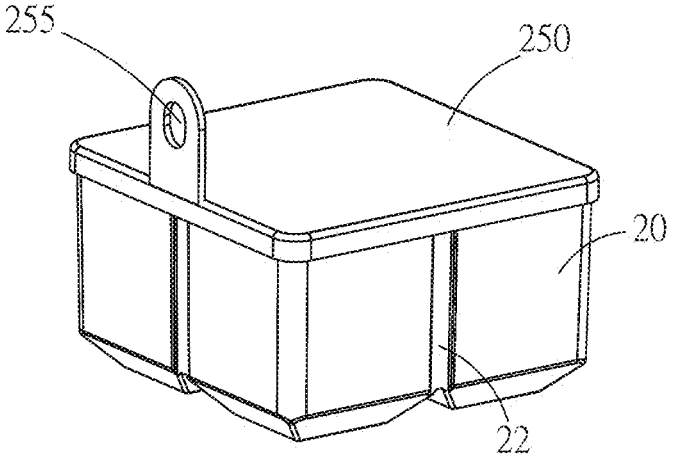

In a preferred embodiment, as shown in FIGS. 9A to 9C, the inner box 20 has different sizes, and can be configured as a single unit, two conjoined units, or four conjoined units. The inner box 20 can hold some small objects, but it is not limited to small hardware screws. There are many small objects that can be placed, such as small handicraft beads that girls love to play with, necklaces, earrings, or hooks for fishing, etc. But in reality, it is not limited to this.

Figure 9D:
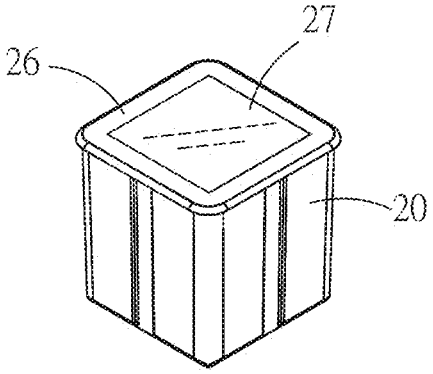
FIG. 9D is a schematic diagram of a parafilm and a magnetic patch attached to the inner box body of the present invention.

In a preferred embodiment, as shown in FIG. 9D, wherein a one-way opening edge portion 21 of the inner box 20 is further configured with a parafilm 26, or the parafilm 26 can be used to replace the small cover 250, so that future product sales can be more diversified. The product can be sold directly on the shelf with simple packaging. After purchase, it can be torn off and placed in the outer box 10.

In a preferred embodiment, as shown in FIG. 9D, wherein the inner box 20 is further configured with a magnetic patch 27 for self-posting. The inner box 20 has a magnetic function to prevent it from being scattered, so as to meet the different practical needs of customers, and is used to hold small fish hooks or precision objects that are easy to fall off.

Figure 10:
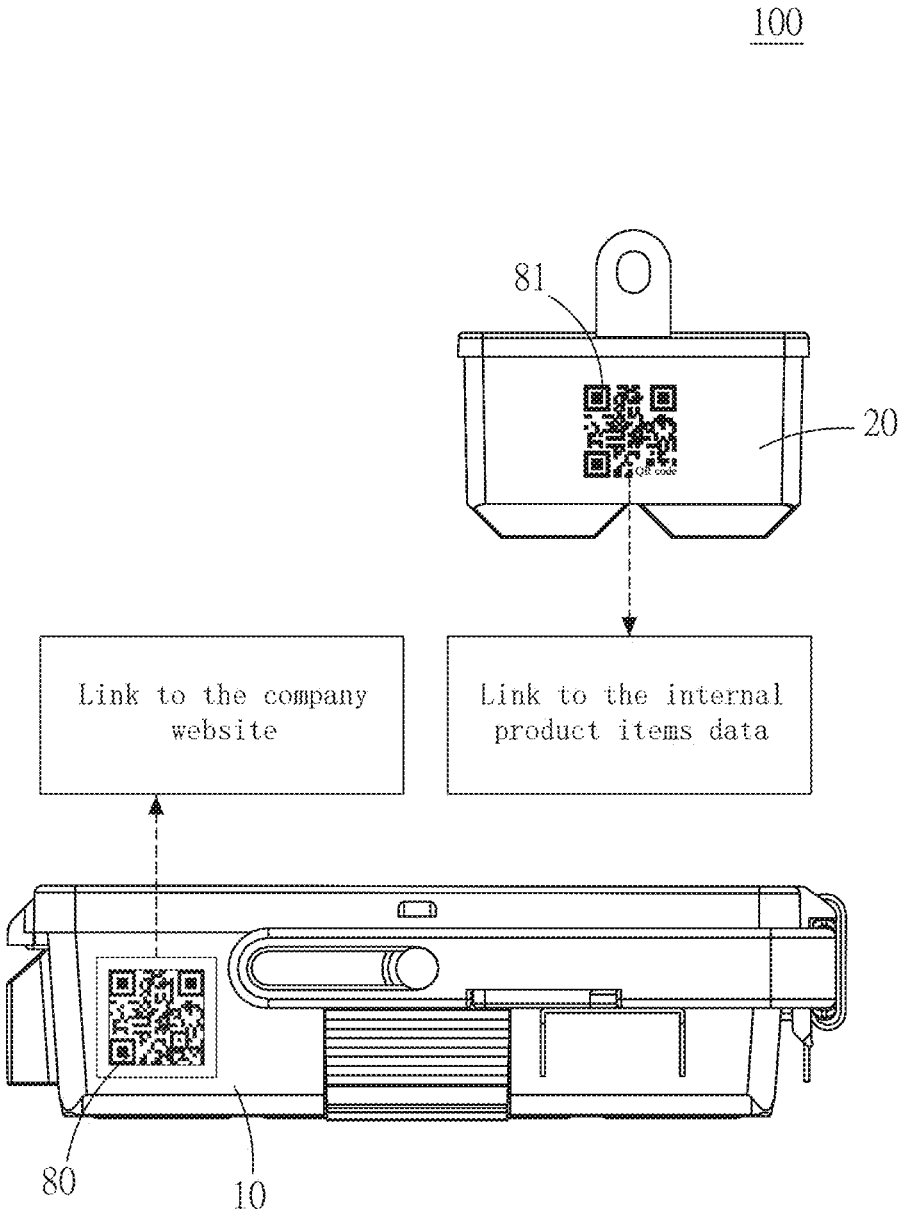
FIG. 10 is an application example of the present invention in which the outer box and the inner box are equipped with QR scanning codes.

In a preferred embodiment, as shown in FIG. 10, wherein the outer box 10 and the inner box 20 are each further configured with a QR scan code 80,81 which can be directly printed or made of stickers, and the QR scan code 80 of the outer box 10 is correspondingly linked to the company's official website, the QR scan code 81 of the inner box 20 corresponds to a traceability information linked to items contained in the inner box 20. It allows consumers to easily scan the company's official website to get the latest information, or to know the product information and anti-counterfeiting traceability of the items in the purchased box.

Compared with the existing conventional structure, the advantage of the structure of the object storage box 100 of the present invention is that not only the inner box 20 can be stored stably in the outer box 10, but also the inner box 20 can be prevented from being mixed and scattered and moved randomly during use. After being taken out, it can be placed in the recessed compartment 120 on the lid 15 for stability. It can also effectively prevent tipping and overturning. It is especially convenient for classifying, placing and stably collecting various small objects. The types are not limited to all kinds. Small items such as screws, nuts, nails, fishhooks, buoys, beads, handicrafts, jewelry and first aid items, etc. The overall effective design is that the inner bottom of the outer box 10 and the top of the lid 15 are configured with the same ridge line 115 to form a plurality of recessed compartment 120, and each inner box 20 is configured with a corresponding beveled bottom 25, so that the inner box 20 can be placed in the corresponding recessed compartment 120 at a fixed position, so as to improve the convenience of positioning the inner box 20.

The product has excellent structural design and good functionality, which can effectively improve the efficiency of sorting and storing objects and can also facilitate the stability of taking out and placing them for use. The structure of the object storage box 100 of the present invention can not only effectively solve the shortcomings of existing storage boxes, but also has many functions such as convenient combination and stacking, handle positioning, oblique support display, mobile phone placement, anti-theft opening, small box packaging and hanging, etc. A practical function. The innovative design can meet modern needs, allowing users to enjoy greater convenience and efficiency when organizing and storing small items on a daily basis.

In summary, the invention is novel and practical and fully meets the patent requirements, and the invention patent application is submitted. However, the foregoing descriptions are only preferred embodiments of the present invention, should not be used to limit the scope of the present invention; therefore, all equivalent changes and modifications made based on the patent scope of the present invention and the content of the creation specification shall be that is within the scope covered by the patent of this invention.

What is claimed is:

1. A system for the storage of objects, comprising:
an outer box (10) and a plurality of inner boxes (20); wherein
said outer box includes a hinged lid (15) and a base; wherein
said hinged lid and base each include crisscrossing ridge lines (115) defining a plurality of compartments (120); wherein
the inner boxes (20) each include a beveled bottom (25) configured to be seated within a single compartment (120) located on either the outer box base or the hinged lid; said outer box (10) further comprising a U-shaped handle (30) pivotally connected to an exterior of the outer box (10); said U-shaped handle (30) comprising an elongated slot (31);
said elongated slot (31) allows the U-shaped handle to be retracted, extended, or positioned to support the outer box (10) on a surface; and
said outer box further comprising snap mechanisms (40) which permits removable stacking attachment of the outer box to another outer box.

2. The system of claim 1 wherein the U-shaped handle (30) includes a bracket (35), said bracket configured to maintain the outer box (10) at an angle when the outer box is supported on a surface by the U-shaped handle.

3. The system of claim 1 wherein the pivoting lid comprises a protruding piece (153) configured to maintain the U-shaped handle upright and perpendicular to the outer box.

4. The system of claim 1, wherein said snap mechanisms include hooks (41) and corresponding buckles (42).

5. The system of claim 1, wherein the hinged lid includes a quick-release latch mechanism (170) which allows for the hinged lid to be removably attached to the outer box.

6. The system of claim 1, wherein the hinged lid further comprises an edge portion (180) with a through hole (181), said through hole configured to accept a tamper-evident frangible member which maintains the hinged lid in closed position.

7. The system of claim 1, wherein the plurality of inner boxes are substantially square or rectangular.

8. The system of claim 1, wherein the plurality of inner boxes each include longitudinal grooves (22).

9. The system of claim 1 wherein the plurality of inner boxes each include covers (250) with a clamping edge (251).

10. The system of claim 1; wherein the plurality of inner boxes include covers (250) with a hanging hole (255).

11. The system of claim 1; wherein the plurality of inner boxes include single or joined sub-units.

12. The system of claim 1, wherein the plurality of inner boxes each include a sealing film (26).

13. The system of claim 1, wherein the plurality of inner boxes each include a magnetic patch (27).

14. The system of claim 1 wherein the system further includes QR scan codes (81) on either the outer box or the plurality of inner boxes linked to traceable information for the contents.

* * * * *